US009663982B1

(12) United States Patent
Cui et al.

(10) Patent No.: US 9,663,982 B1
(45) Date of Patent: May 30, 2017

(54) DOMESTIC COOLING APPLIANCE WITH TWO DOORS AND A MOVING DEVICE FOR MOVEMENT COUPLING OF THE DOORS

(71) Applicant: BSH HAUSGERAETE GMBH, Munich (DE)

(72) Inventors: Yang Cui, Giengen (DE); Yun Dai, Giengen an der Brenz (DE); Alfred Raab, Huettlingen (DE); Andreas Kempte, Giengen (DE)

(73) Assignee: BSH Hausgeraete GmbH, Hannover (DE)

( * ) Notice: Subject to any disclaimer, the term of this patent is extended or adjusted under 35 U.S.C. 154(b) by 0 days.

(21) Appl. No.: 15/019,363

(22) Filed: Feb. 9, 2016

(51) Int. Cl.

| | |
|---|---|
| ***F25D 23/00*** | (2006.01) |
| ***E05F 17/00*** | (2006.01) |
| ***F25D 23/02*** | (2006.01) |
| ***F25D 11/02*** | (2006.01) |

(52) U.S. Cl.
CPC ..... *E05F 17/004* (2013.01); *F25D 11/02* (2013.01); *F25D 23/02* (2013.01); *F25D 23/028* (2013.01); *E05F 2017/008* (2013.01); *E05Y 2900/132* (2013.01); *E05Y 2900/31* (2013.01); *F25D 2323/021* (2013.01)

(58) Field of Classification Search
CPC ... E05F 17/00; E05F 17/004; E05F 2017/008; E05Y 2900/132; E05Y 2900/31; F25D 23/02; F25D 23/028; F25D 2323/021
See application file for complete search history.

(56) References Cited

U.S. PATENT DOCUMENTS

| | | | | | |
|---|---|---|---|---|---|
| 3,009,458 | A * | 11/1961 | Pearce | A47B 96/16 | 126/190 |
| 3,216,776 | A * | 11/1965 | Carbary | E05F 17/004 | 292/251.5 |
| 4,641,460 | A * | 2/1987 | Kriegel | E05F 17/004 | 49/104 |
| 2009/0145031 | A1* | 6/2009 | Collene | E05F 1/1066 | 49/113 |
| 2010/0139169 | A1* | 6/2010 | Patil | E05F 17/004 | 49/103 |
| 2014/0070685 | A1* | 3/2014 | Yantis | F24C 15/02 | 312/319.2 |
| 2014/0283811 | A1* | 9/2014 | Kershner | E05F 17/004 | 126/192 |

* cited by examiner

*Primary Examiner* — Daniel Rohrhoff
(74) *Attorney, Agent, or Firm* — Laurence A. Greenberg; Werner H. Stemer; Ralph E. Locher

(57) ABSTRACT

A domestic cooling appliance has a housing and at least one receiving space for receiving food and first and second doors for closing the receiving space in the front. A first door is pivotally arranged at the housing a second door is pivotally arranged at the housing. The two doors are adjacent one another for closing the at least one receiving space at the front. The two doors are coupled to each other by a moving device, by which, upon operation of one of the two doors, automatically a concurrent movement of equal type of the other door is achieved.

14 Claims, 6 Drawing Sheets

DOMESTIC COOLING APPLIANCE WITH TWO DOORS AND A MOVING DEVICE FOR MOVEMENT COUPLING OF THE DOORS

BACKGROUND OF THE INVENTION

Field of the Invention

The invention relates to a domestic cooling appliance with a housing and at least one receiving space for receiving food. The domestic cooling appliance further comprises a first door which is pivotally arranged at the housing. Moreover, the domestic cooling appliance comprises a second door, which is also pivotally arranged at the housing. The two doors are arranged adjacent to each other for closing the at least one receiving space at the front.

Such domestic cooling appliances are known and are also referred to as "French door appliances". The two doors are thus as it were formed as wing doors which close a common continuous receiving space at the front.

Thus, with these appliances it is required that in order to have extensive and unrestricted access to the entire receiving space from the front invariably both doors have to be opened. It is thus required that they are each individually grasped and pulled open by a user.

SUMMARY OF THE INVENTION

It is accordingly an object of the invention to provide a domestic cooling appliance with two doors and a movement device for coupling the movement of the doors which overcomes the above-mentioned and other disadvantages of the heretofore-known devices and methods of this general type and which provides for a domestic cooling appliance wherein the operation of the plurality of doors is simplified and rendered more user-friendly.

With the foregoing and other objects in view there is provided, in accordance with the invention, a domestic cooling appliance, comprising:

a housing;

at least one receiving space for receiving food formed in said housing;

two doors including a first door pivotally mounted at said housing and a second door pivotally mounted to said housing;

said two doors being arranged adjacent one another for closing said at least one receiving space at a front thereof;

a moving device coupling said two doors to one another so that, upon operation of one of said two doors, a concurrent movement of equal type is automatically effected of the other of said two doors.

In other words, the domestic cooling appliance according to the invention comprises a housing with at least one receiving space for receiving food. The domestic cooling appliance further features a first door which is pivotally arranged at the housing. The domestic cooling appliance comprises a second door separate from the first door, which is pivotally arranged at the housing. The two doors are arranged adjacent to each other for closing the at least one receiving space at the front. An essential idea of the invention is to be seen in that the two doors are coupled to each other by a moving device of the domestic cooling appliance. The moving device is formed such that upon operation of one of the two doors automatically a concurrent movement of equal type of the other door is achievable. It is thus achieved that due to such a specific design of a domestic cooling appliance with two separate doors which are provided for closing a common and thus continuous receiving space, specifically only one of the two doors has to be grasped and operated with the required force by a user and thereupon the other door is moved in a corresponding manner and in particular simultaneously. Thus opening, which constitutes a first type of motion, and closing, which constitutes a second type of motion, is rendered easier and more user-friendly. Moreover, the operation effort involved in operating both doors is reduced and opening and closing can be performed more quickly.

The doors are each pivotable about a vertical axis, wherein both axes are in particular parallel to each other. It is further preferably provided that the two doors are of the same height and thus in a vertical direction and accordingly in the height direction of the domestic cooling appliance arranged at the same level of height.

Also, in the depth direction of the domestic cooling appliance the two doors have the same depth position so that they are positioned side by side without overlap and form front side outer components of the domestic cooling appliance.

In an advantageous embodiment the moving device features a purely mechanical design. This means that no electromotive drive or the like is provided. Thus, the moving device is designed to be highly reliable and permanently robust.

It is in particular provided that the moving device has a first operating unit at the first door and a second operating unit at the second door. The first operating unit is connected to the second operating unit by a belt, by which a movement of one operating unit, which is capable of being generated by a movement of the door at which this operating unit is arranged, can be transferred to the other operating unit. This means that the first operating unit is directly connected to the first door via at least one component of said operating unit. The same applies to the second operating unit.

This is a highly advantageous embodiment since a particularly play-free and low-tolerance principle of movement and movement transmission is realized. Besides, by this embodiment also a very simple design is enabled, which is highly functional and largely unsusceptible to interference. Thus, a highly continuous movement of both doors is enabled so that undesired jolting movements or too harsh an impact of the doors at end positions can be prevented.

It is in particular provided that the belt is a rope or a chain. These designs are highly deformable and thus also small deflections with tight radii can be formed. Thus a compact design is achieved.

In an advantageous embodiment of this moving device it is provided that the belt is arranged between the operating units such that it crosses itself. Since upon opening the two doors swing in different directions and in this embodiment thus the first door, for instance, pivots clockwise around its axis of rotation and the second door necessarily pivots anticlockwise around its axis of rotation, such a design of an intercrossed belt is highly advantageous. For, in consequence of this design, a direction of rotation generated upon operation of a first door can easily be transferred to the other door as an inverse or opposite direction of operation. Thus, extensive and complex rotation direction transforming units are not required. This is advantageous in that on the one hand the number of components can be minimized and on the other hand failure susceptibility specifically at this place of rotation transformation does not occur.

In an advantageous embodiment it is provided that the first operating unit has a coupling rod which is pivotally arranged at or connected to the first door. Thus, the coupling rod with one end directly abuts on the first door. It is preferably provided that the coupling rod is pivotally connected to an upper area, in particular an upper narrow edge of the door, which can in particular be formed by an upper door end profile. Thus, a position for the place of connection is provided which is not obstructive as regards opening and closing as well as accessibility of the receiving space from the front. This embodiment is also particularly advantageous in that thus in an upper housing area which is positioned between an upper wall of an inner container which delimits the receiving space with its walls and an upper ceiling area of an outer container spaced apart therefrom further components of the operating unit can be arranged. Consequently, such further components can be positioned in a space-saving manner and covered on the front side, which is enabled by a wall between the inner container and the outer container. Thus, said operating unit is also covered and invisible from the front except for the coupling rod that protrudes in the open position of the door.

It is preferably provided that the coupling rod is a toothed rack. Thus, with a serrated counterpart of the operating unit a particularly effective principle can be achieved. Specifically, in this context, a serrated design enables precise motion guidance which is also capable of absorbing higher forces, without the occurrence of functional impairments of the coupling involved. Besides, with these designs wear is minimized and thus a coupling enabled between the coupling rod and a further element of the operating unit designed to be coupled thereto, which is permanently play-free or exhibits only a desired amount of play.

It is in particular provided that the first operating unit features a rotatable coupling wheel, which is arranged at the housing externally to the first door and to which the belt is firmly coupled such that a rotation of the coupling wheel effects a rotary motion of the belt. Thus direct coupling with the coupling rod is achievable and the number of components of the operating unit is kept at a minimum. Still, a force transmission from the door via the belt and the related transmission path is enabled by the individual components in a very precise manner. This effect chain features minimum play so that advantageously the motion path of the first door is equal or nearly equal to the motion path of the second door.

Advantageously, said rotatable coupling wheel of the first operating unit is a tooth wheel. Thus, the direct and highly functional serrated coupling to the toothed rack is provided. The coupling wheel is arranged at the housing externally to the first door and there in particular arranged to be stationary. This means that the coupling wheel regarded as a whole does not change its position at the housing consequent upon the occurrence of an operation but that it is capable of rotating around an axis of rotation which, however, is per se stationary, in particular a vertical axis of rotation, and that the coupling wheel is thus capable of rotating at the fixed place relative to the housing.

Advantageously, the coupling wheel of this first operating unit is arranged in a receiving housing of said first operating unit. Thus, a protected position is provided for the coupling wheel such that highly-functional operation thereof is permanently enabled.

The coupling rod of this first operating unit enters the receiving housing via an inlet and exits the receiving housing via an outlet. Thus, direct coupling between the coupling rod and the coupling wheel is effected in the receiving housing. Thus, to a certain extent, the receiving housing also enables guidance of the coupling rod.

Advantageously, it is also provided that the belt enters said receiving housing via a further inlet and exits the receiving housing via a further outlet. Thus, in the receiving housing a protected coupling of the belt with the coupling wheel is enabled. Due to the compact design of the receiving housing the belt is also prevented from slipping off the coupling wheel.

It is in particular provided that the coupling rod of the first operating unit is directly coupled to the coupling wheel of the first operating unit. Thereby, also, further components and a lengthening of the effect chain can be dispensed with.

It is in particular provided that in the coupling area between the coupling rod and the coupling wheel an additional separate positioning bracket is arranged which extends from the coupling wheel across the coupling rod and engages behind the coupling rod. Thus, in exactly the place where said two elements are connected to each other, an undesired lifting off or detachment from each other can be prevented. Advantageously, the positioning bracket is rotatable relative to the coupling wheel, in particular around an axis which is coaxial to the rotation axis of the coupling wheel. Thus, allowance is made for the movement of the coupling area between the coupling rod and the coupling wheel that is concomitant with the movement of a door and in consequence of such concomitant movement of the positioning bracket a dynamic guiding and retaining function is achievable.

Advantageously, the second operating unit is identical in design to the first operating unit. Here, likewise, in particular a coupling rod, a coupling wheel and a receiving housing are provided.

Due to such an advantageous symmetrical design of the moving device the operating principle is as it were reflected and the particularly smooth and even movement of the doors achieved.

As regards this concept of the moving device, in an advantageous embodiment an opening angle of the doors each greater than 100°, in particular greater than 120°, preferably 130°, is enabled.

In a further advantageous embodiment it can also be provided that the moving device has a motor drive by which the movement of a door is effected at least partially automatically and thus motorically. In this embodiment it can be provided that the domestic cooling appliance features an operating element upon operation of which by a user the motor drive is started through control via a control unit and the door is thus moved without having to be grasped by a user and without impact by a corresponding pulling or thrust force. Via the moving device a corresponding concurrent movement of the respective other door coupled thereto is then automatically effected.

In a further advantageous embodiment it is provided that the moving device can be activated and deactivated. This means that the coupled state of the doors for their concurrent movement can be activated by the user himself. With regard thereto it can be provided, for example, that a corresponding operating element is arranged at a handle of the door. If simultaneously with the grasping of the handle also said operating element is operated by the user, the activated state of the moving device can be attained. If this operating element is not operated by the user, in particular if in grasping the handle it is not grasped simultaneously, the moving device remains in the deactivated state. This means that in the deactivated state of the moving device only a respective one of the two doors is opened or closed independently of the other.

In an alternative embodiment of a moving device said moving device has a first operating unit with a coupling rod, which is pivotally arranged at the first door. In this embodiment the moving device features a second operating unit which is separate from the first operating unit, which also comprises a coupling rod of its own, which is pivotally arranged at the second door. The two coupling rods are connected to a scissor gear of the moving device such that a movement of one coupling rod is transferable to the other coupling rod via the scissor gear so that again upon operation of one of the two doors automatically a concurrent movement of equal type of the other door is achievable. Due to the aforementioned coupling by means of the scissor gear likewise a mechanically robust motion transfer is enabled and yet such motion transfer can occur in a very precise manner with no or only minimum play involved. The present embodiment also enables the absorption and transfer of comparatively large forces without functional impairment or rapid and extensive wear.

In this embodiment of the moving device it is preferably provided that an end of the first coupling rod which faces away from the first door and which is flexibly connected to a first end of the scissor gear is guided in a first non-linear guide rail in a guiding element, particularly a plate-shaped guiding element, of the moving device. Thus, motion transfer, the relative movement between the coupling rod and the scissor gear and the internal movement of the scissor gear are enabled to be very precise. In particular, said end of the first coupling rod is connected to the first end of the scissor gear via a first connecting rod which is separate from the coupling rod. Thus, the coupling rod can be designed to be relatively small and, accordingly, also the scissor gear can feature minimal dimensions. The connecting rod is an inherently rigid rod such that presently also a very direct and immediate transfer of motion from the coupling rod to the scissor gear is enabled.

It is in particular also provided that an end of the second coupling rod which faces away from the second door and which is flexibly connected to a second end of the scissor gear is guided in a second non-linear guide rail in the guiding element, which is specifically plate-shaped. Here, the advantages described above with regard to the connection of the first coupling rod with the scissor gear apply accordingly.

Advantageously, the first non-linear guide rail features the shape of an arrowhead. Thus, two linear sections of said guide rail are provided, which join each other at an angle at the tip of the aforementioned arrowhead shape. In particular, said two linear guide rail sections have the same length. Advantageously, the second non-linear guide rail is formed correspondingly.

Preferably, the arrowhead shapes of the two guide rails are oriented towards each other, i.e. the tips of these arrowhead shapes face each other in the plate-shaped guiding element. This design enables a coupled guiding of the two coupling rods with their ends, which are connected in the scissor gear and which are in particular connected via the respective connecting rods, in respectively corresponding guide rails sections and further therein in respectively corresponding places such that due to the folding and unfolding of the scissor gear a highly precise and direct force transfer and thus motion transfer from one door to the other is achievable.

The linear connecting rods are arranged at an angle to a central axis or symmetry axis of the scissor gear along the entire motion path of the doors. Thus, in the respective guide rail sections motion transfer is rendered particularly precise, which results in particularly continuous and smooth motion guidance.

The ends of the coupling rods which are flexibly connected to the scissor gear, in particular via the connecting rods, are those ends which are opposite the ends of the coupling rods by which said coupling rods are flexibly connected to the respective door.

In a further advantageous embodiment it is provided that a first end of the scissor gear is guided in a first linear guide rail and a second end of the scissor gear in a second linear guide rail. These linear guide rails are formed separately from the non-linear guide rails in the plate-shaped guiding element. Thus, the folding and unfolding of the scissor gear is advantageously guided in such a way that a tilting or splaying of the scissor gear prevented.

It is advantageously provided that the linear guide rails are formed along a central axis or symmetry axis of the scissor gear and are thus arranged in series. In a further advantageous embodiment it is provided that said central axis of the scissor gear and thus, correspondingly, a connecting line between the non-linear guide rails extends such between the non-linear guide rails that it abuts on the tips of the non-linear, specifically arrowhead-shaped, guide rails. The motion principle and the corresponding direct motion transfer are thus again improved.

Advantageously, in this alternative embodiment of the moving device an opening angle of the doors of maximally 100° is enabled. It is in particular provided that, starting from the closed position of a door, at an opening angle between 30° and 40°, in particular between 34° and 36°, the scissor gear is maximally compressed and thus maximally folded together. Preferably, at this position a connecting rod, which is preferably present, is horizontally oriented, i.e. it lies on the central axis of the scissor gear. It is further in particular provided that at this specific opening angle the free end of a coupling rod, which is coupled to the scissor gear via the connecting rod, has reached the tip of the respective arrowhead-shaped non-linear guide rail. Consequent upon a further opening of the one door, the scissor gear is then again unfolded since the ends of the coupling rods are positioned in those sections of the non-linear guide rails which obliquely extend away from each other.

The terms "above", "below", "in front", "behind", "horizontal", "vertical", "depth direction", "width direction", "height direction" etc. signify the positions and orientations given if the appliance is used and positioned as intended and an observer is standing in front of and looking in the direction of the appliance.

Further features of the invention are apparent from the claims, the figures and the description of the figures. The features and feature combinations previously mentioned in the description and the features and feature combinations mentioned below in the description of the figures and/or shown in the figures alone are usable not only in the respectively specified combination, but also in other combinations or else alone, without leaving the scope of the invention. Thus, also embodiments are to be regarded as comprised and disclosed by the invention, which are not explicitly shown and explained in the figures, but which derive and are producible from the illustrated explanations by separated feature combinations. Also, embodiments and feature combinations are to be regarded as disclosed which thus do not exhibit all features of an originally formulated independent claim. Additionally, embodiments and feature combinations are to be regarded as disclosed, particularly by the explanations provided above, which go beyond or depart from the feature combinations presented in the back references of the claims.

Other features which are considered as characteristic for the invention are set forth in the appended claims.

Although the invention is illustrated and described herein as embodied in a domestic cooling appliance with two doors and a moving device for movement coupling of the doors, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

Identical or functionally equivalent elements bear the same reference numbers throughout the figures.

DETAILED DESCRIPTION OF THE INVENTION

Figure 1:
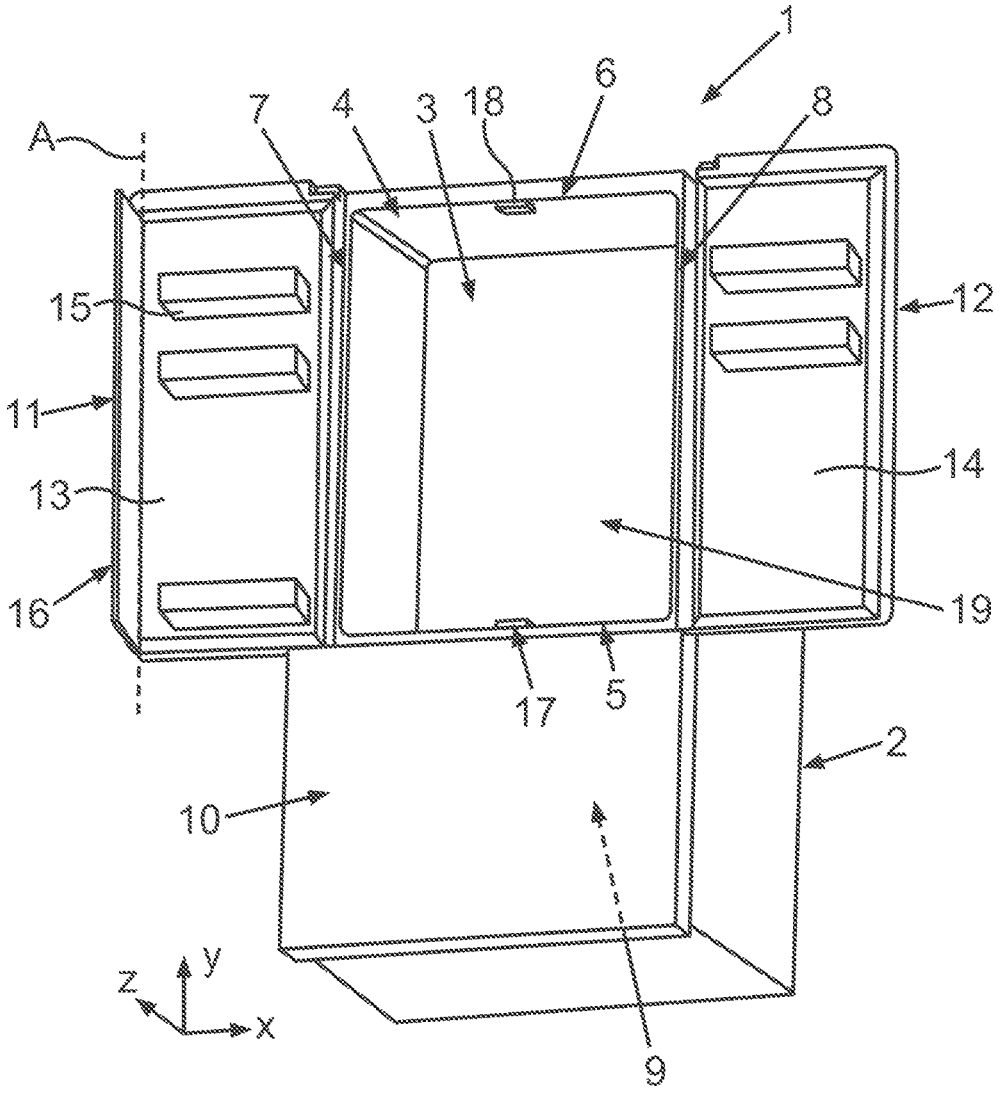
FIG. 1 a perspective view of an embodiment of a domestic cooling appliance according to the invention.

Referring now to the figures of the drawing in detail and first, particularly, to FIG. 1 thereof, there is shown a perspective view a domestic cooling appliance 1, which has a housing 2. In the housing 2 a first receiving space 3 is formed, which is configured to receive food. The receiving space 3 is a continuous receiving space, which, accordingly, features a proportionate volume and which is delimited by walls of an inner container 19. The first receiving space 3 is delimited by walls of an inner container. At the front a receiving opening 4 is formed, which lies in the x-y plane and thus in a plane defined by the width direction and the height direction of the domestic cooling appliance, and which is a continuous receiving opening 4 or charging opening by which an uninterrupted area is enclosed. At the front the receiving opening 4 is delimited by a first delimiting edge or a first lower delimiting wall 5, an opposite second upper delimiting wall 6 or delimiting edge and, respectively adjacent thereto, opposite vertical delimiting edges or delimiting walls 7 and 8. Thus, the receiving opening 4 is circumferentially delimited by a delimiting edge and with regard to the area enclosed thereby constitutes a quadrangle, in particular a rectangle.

The receiving space 3 is preferably a cooling space where food can be stored at temperatures above the freezing point, in particular at temperatures between +4° C. and +10° C.

The exemplary domestic cooling appliance 1 according to FIG. 1 moreover comprises a second receiving space 9, which is separate from the receiving space 3 and which in a vertical direction and thus in the height direction of the domestic cooling appliance 1 is positioned underneath the first receiving space 3.

The further receiving space 9 can be closed by a single door 10, which is shown in its completely closed state in FIG. 1. The door 10 is arranged at the housing 2 and rotatable around a rotation axis which extends in the height direction. Preferably, however, the door 10 is part of a drawer which can be moved in a linear motion in the depth direction.

The domestic cooling appliance 1 moreover comprises a first door 11 and, separate thereto, a second door 12, which is also pivotally arranged at the housing 2. The two doors 11 and 12 are arranged so as to close the receiving space 3. In FIG. 1 they are shown in the opened state. On inner sides 13 and 14 of the doors 11 and 12, door racks are provided by way of example, of which only one is indicated by the reference number 15.

Preferably, at the first door 11 a lath-shaped and thus linear door pillar 16 is arranged, which is arranged there pivotally and thus movably with regard to the first door 11. The door pillar 16 is pivotable around a rotation axis A, which is oriented in the height direction, relative to the first door 11. The door pillar 16 is a single-piece component and in the height direction extends across a dimension that corresponds to the clear width between two guiding devices 17 and 18. Therein, the first guiding device 17 is arranged at the first delimiting wall 5 and the second guiding device 18 at the opposite second delimiting wall 6.

In the open position of the first door 11 shown in FIG. 1, the door pillar 16 extends in a plane which is oriented at an angle, in particular a right angle, to the plane in which the first door 11, in particular a door panel of said door 11, extends.

Figure 2:
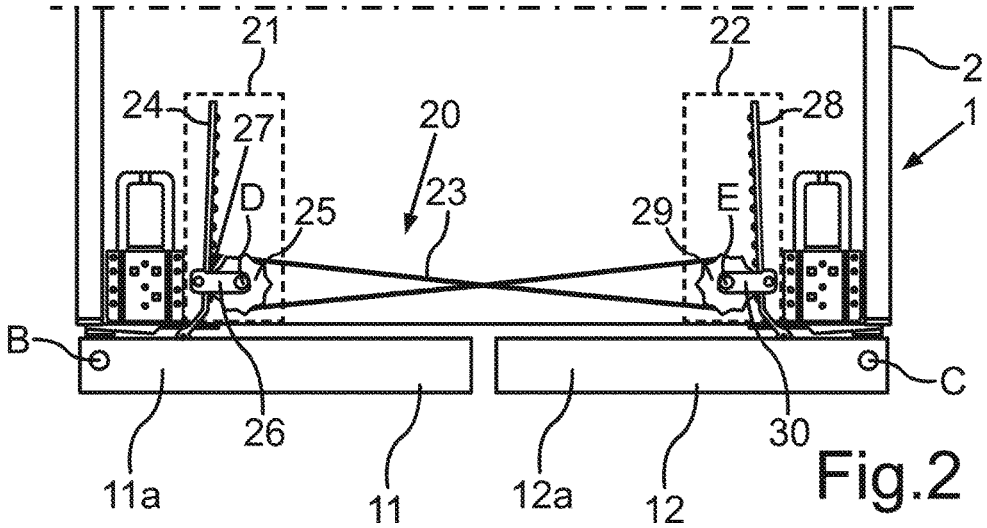
FIG. 2 a top view of a first embodiment of a domestic cooling appliance according to the invention with a first embodiment of a moving device in the closed position of the doors.

FIG. 2 shows a partial top view of the domestic cooling appliance 1, wherein presently the doors 11 and 12 are shown in the closed end position. The domestic cooling appliance 1 comprises a moving device 20, by which the two doors 11 and 12 are coupled to each other. Consequent upon operation of only one of the two doors 11, 12, automatically a concurrent movement of equal type of the respective other door 12, 11 is achievable by the moving device 20. With regard thereto, opening constitutes one type of motion and closing constitutes a further type of motion.

In the present embodiment the moving device 20 features a purely mechanical design. However, it can also be envisaged that an additional motor drive is present.

The embodiment of the moving device 20 shown in FIG. 2 comprises a first operating unit 21 fastened or connected to the first door 11. Besides, the moving device 20 comprises a second operating unit 22 separate from the first operating unit 21, which is connected to the second door 12. In the present embodiment, the moving device 20 additionally comprises a belt 23, by which the two operating units 21 and 22 are coupled. The belt 23 can be a rope or a chain. As can be gathered from the partial or top view, said belt 23 is arranged such that it crosses itself. The belt 23 is a continuous belt that closes on itself. By the belt 23 a motion of an operating unit, for instance a motion of the operating unit 21, which has been initiated by a movement of the first door 11, can be transferred to the other operating unit 22.

The first operating unit 21 comprises a coupling rod 24 which is directly connected to the door 11. In particular, the coupling rod 24 is thus pivotally connected to an upper door end profile 11 a of the first door 11 at a rear end thereof which, in the closed state of the door 11, faces the receiving space 3 that is capable of pivoting around an axis which is perpendicular to the plane of the figures. In the embodiment the coupling rod 24 is a toothed rack.

Besides, the first operating unit 21 comprises a coupling wheel 25, which is in particular a tooth wheel. The coupling wheel 25 is directly coupled to the coupling rod 24. The coupling wheel 25 is arranged externally to the first door 11 and positioned immovably in the housing 2 such that as a whole it cannot be moved in relation to the housing 2, but only rotated around an axis D which is perpendicular to the plane of the figures and thus extends in the height direction (y direction) of the domestic cooling appliance 1. As also shown in FIG. 2, the first door 11 is pivotable around an axis B. This axis B is also perpendicular to the plane of the figures and thus parallel to the axis D. Correspondingly, the second door 12 is pivotable around an axis C, which is also perpendicular to the plane of the figures.

Besides, the first operating unit 21 features a positioning bracket 26, which in a direct coupling area 27, in which the coupling rod 24 is directly coupled to the coupling wheel 25, holds or positions these two components relative to each other. Thus, a slipping or decoupling of the coupling rod 24 from the coupling wheel 25 can be prevented. The positioning bracket 26 is arranged and formed such that it extends from the coupling wheel 25 across the coupling rod 24 and engages behind the coupling rod 24.

Moreover, the positioning bracket 26 is also rotatable around the axis D and thus pivotable in relation to the coupling wheel 25. This is advantageous in that the positioning bracket 26 is precisely at the position of the coupling area 27. Due to the possibility of relative motion between the coupling rod 24 and the coupling wheel 25, this coupling area 27 can shift, as shown according to FIG. 2 and FIG. 3.

In the embodiment, the second operating unit 22 is identical in design to the first operating unit 21. Thus, the second operating unit 22 also comprises a coupling rod 28, a coupling wheel 29 and a positioning bracket 30. Moreover, it is likewise rotatable around an axis E with the coupling wheel 29.

The belt 23 is connected to the two coupling wheels 25 and 29 such that a rotation of a coupling wheel 25, 29 directly results in a corresponding displacement or rotary motion of the belt 23, whereby in turn a corresponding rotary motion of the respectively other coupling wheel 25, 29 is effected.

If starting from the closed position of the doors 11 and 12 according to FIG. 2 for instance the first door 11 is opened, in particular due to being grasped by a user, a pulling force is generated by said user which acts on the door 11. Due to the resultant pivoting around the axis B and the movement of the coupling rod 24 initiated thereby, the coupling wheel 25 is caused to rotate, whereby a displacement or rotary motion of the belt 23 is caused, whereby in turn the coupling wheel 29 is caused to rotate. In consequence of this rotary motion of the coupling wheel 29 automatically a concomitant movement of the coupling rod 28 is effected, whereby the second door 12 automatically swings open.

Figure 3:
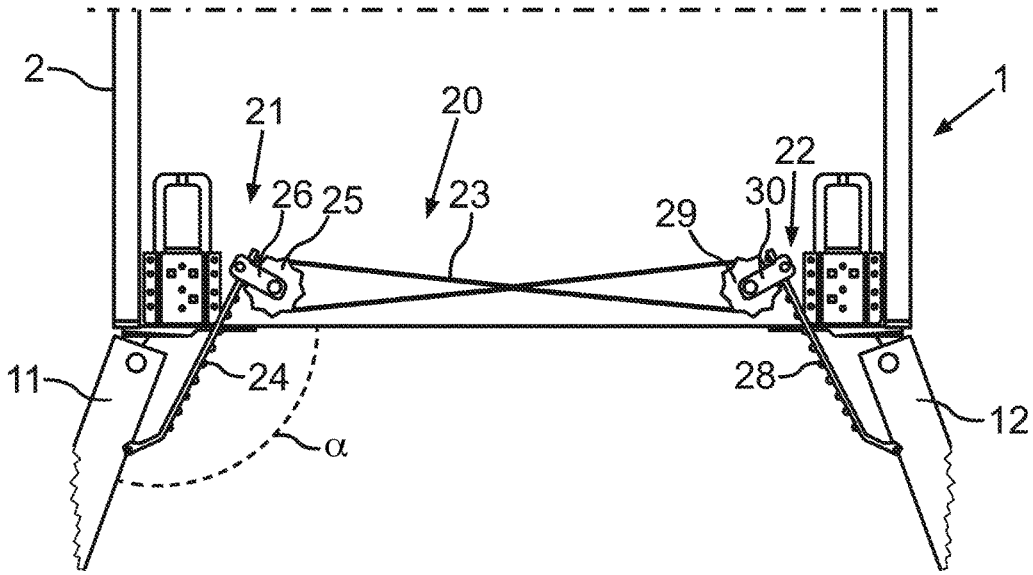
FIG. 3 the representation according to FIG. 2 in the maximally open position of the doors.

FIG. 3 shows a top view of the domestic cooling appliance 1, in which the doors 11 and 12 are shown in their open end position. In this embodiment it is particularly provided that a maximum opening angle $\alpha$ is greater than 120°, preferably 130°.

Figure 4:
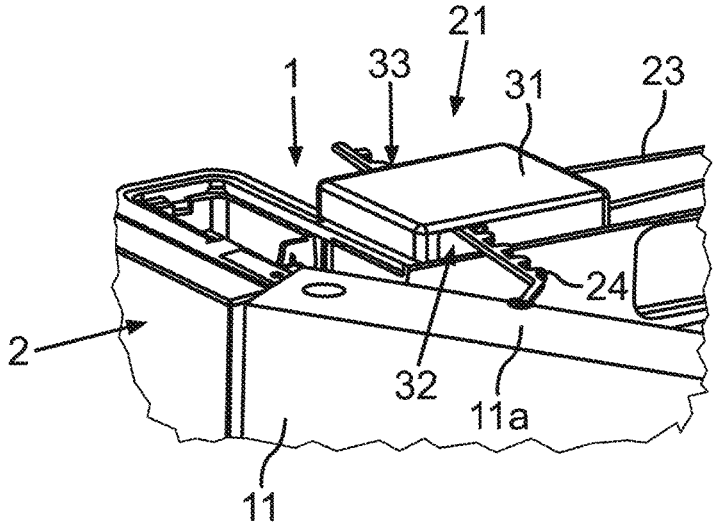
FIG. 4 a perspective partial view of components of the embodiment according to FIG. 2 and FIG. 3.

FIG. 4 shows in a perspective view a portion of the domestic cooling appliance 1. It can be seen that the first operating unit 21 has a receiving housing 31. Therein, the coupling wheel 25 is arranged. Besides, it can be seen that the coupling rod enters the receiving housing 31 via an inlet 32 and exits the receiving housing 31 through an outlet 33 formed on the opposite side of the receiving housing 31. The belt 23 also enters the receiving housing 31 via a further inlet which is not shown and exits the receiving housing 31 via a further outlet which is not shown.

The operating units 21 and 22 are in particular arranged in an upper area of the housing 2, in particular above a top wall of the inner container 19 and beneath a top wall of an outer container of the housing 2. The outer container of the housing 2 encloses the inner container 19.

Figure 5:
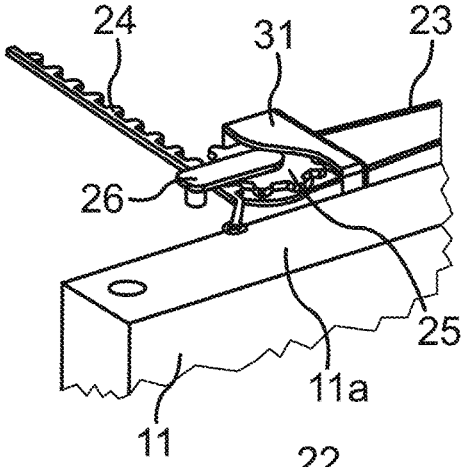
FIG. 5 a further representation of components according to FIG. 4.

FIG. 5 presents the portion illustrated in FIG. 4 in a different perspective and shows the inside of the receiving house 31. The positioning bracket 26 is shown to extend across and engage behind the coupling rod 24.

Figure 6:
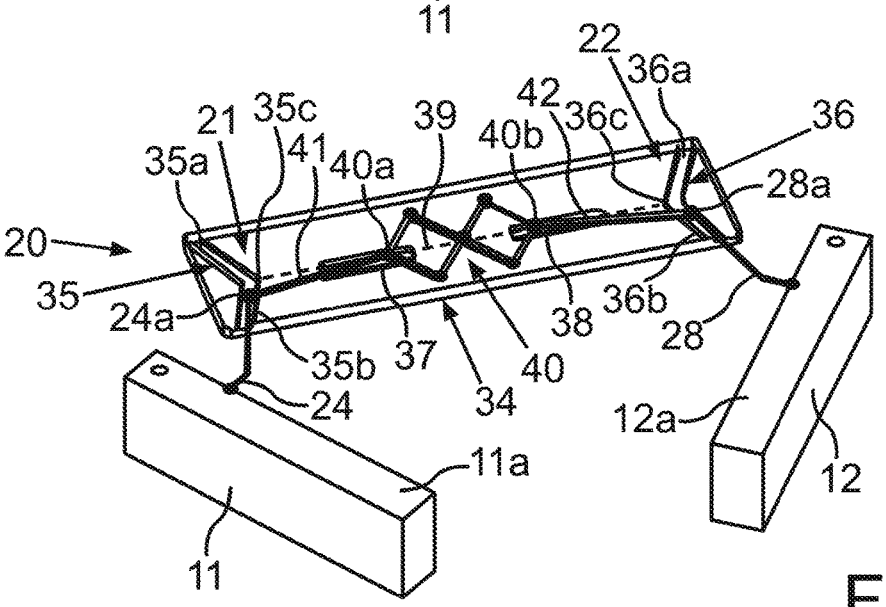
FIG. 6 a perspective views of a further embodiment of a moving device for coupling the doors.

FIG. 6 shows a perspective view of a further embodiment of a moving device 20. In this embodiment likewise an attachment of coupling rods 24 and 28 of different operating units 21 and 22 is provided. Here, likewise, the pivotable joints connecting the coupling rods 24 and 25 to the doors 11 and 12 are specifically provided at the upper door end profiles 11 a and 12*a*.

In these embodiments, the coupling rods 24 and 28 are not toothed racks.

In this embodiment, the moving device 20 comprises a guiding element 34, which is in particular plate-shaped. In this plate-shaped guiding element 34 a first non-linear guide rail 35 is formed. The first coupling rod 24 engages into this non-linear guide rail 35 with a front end 24*a* and is guided therein. Besides, the guide rail 35 is formed with a first linear guide rail section 35*a* and a second guide rail section 35*b* which joins the first linear guide rail section 35*a* at an angle. The non-linear guide rail 35 presently features the shape of an arrowhead. Correspondingly, at the opposite end of the plate-shaped guiding element 34 a further second non-linear guide rail 36 is formed, which has the same form as the first non-linear guide rail 35. Said second non-linear guide rail 36 has a first linear guide rail section 36*a* and a second linear guide rail section 36*b* which joins the first linear guide rail section 36*a* at an angle. The second non-linear guide rail 36 also features the shape of an arrowhead. A tip 35*c* of said arrowhead shape of the first non-linear guide rail 35 faces the second non-linear guide rail 36. Correspondingly, in particular a tip 36*c* of the second arrowhead-shaped guide rail 36 faces the first non-linear guide rail 35.

Besides, a free front end 28*a* of the second coupling rod 28 is guided in the second non-linear guide rail 36.

Moreover, in the plate-shaped guiding element 34 a first linear guide rail 37, which is separate from the non-linear guide rails 35 and 36, and a second linear guide rail 38 separate thereto is formed. The two linear guide rails 37 and 38 are arranged on a connecting line 39, wherein this connecting line 39 is linear. In addition, said connecting line 39 also abuts on the tips 35*c* and 36*c*. In particular, this connecting line 39 is also a central line or symmetry line of the scissor gear 40. The scissor gear 40 is a component of the moving device 20. This scissor gear 40 with a first end 40*a* is guided in the first linear guide rail 37 and with an opposite second end 40*b* in the second linear guide rail 38.

In the embodiment it is envisaged that between the end 24*a* of the coupling rod 24 and the first end 40*a* of the scissor gear 40 there is no direct flexible coupling provided, but an additional, specifically a linear and inherently rigid, connecting rod 41.

It is moreover provided that the end 28*a* of the coupling rod 28 is flexibly connected to the second end 40*b* of the scissor gear and specifically, according to the embodiment, connected thereto not directly, but via a second straight, inherently rigid connecting rod 42. The scissor gear 40 can be folded and unfolded along the connecting line 39 and is thus capable as it were of contraction and expansion.

FIG. 7 again shows a top view of the domestic cooling appliance 1 and thus a view thereof in the x-z plane, wherein presently the doors 11 and 12 are shown in their completely closed end position. As can be gathered from this embodiment, the end 24*a* is placed in the rear guide rail section 35*a*, which is spaced further from the door. The connecting rod 41 is presently arranged at an angle to the connecting line 39 and thus not parallel thereto.

Analogously, the second connecting rod 42 is arranged at a corresponding angle to the connecting line 39. Here, likewise, the front end 28*a* is placed in the guide rail section 36*a*, which is spaced further from the door.

Figure 7:
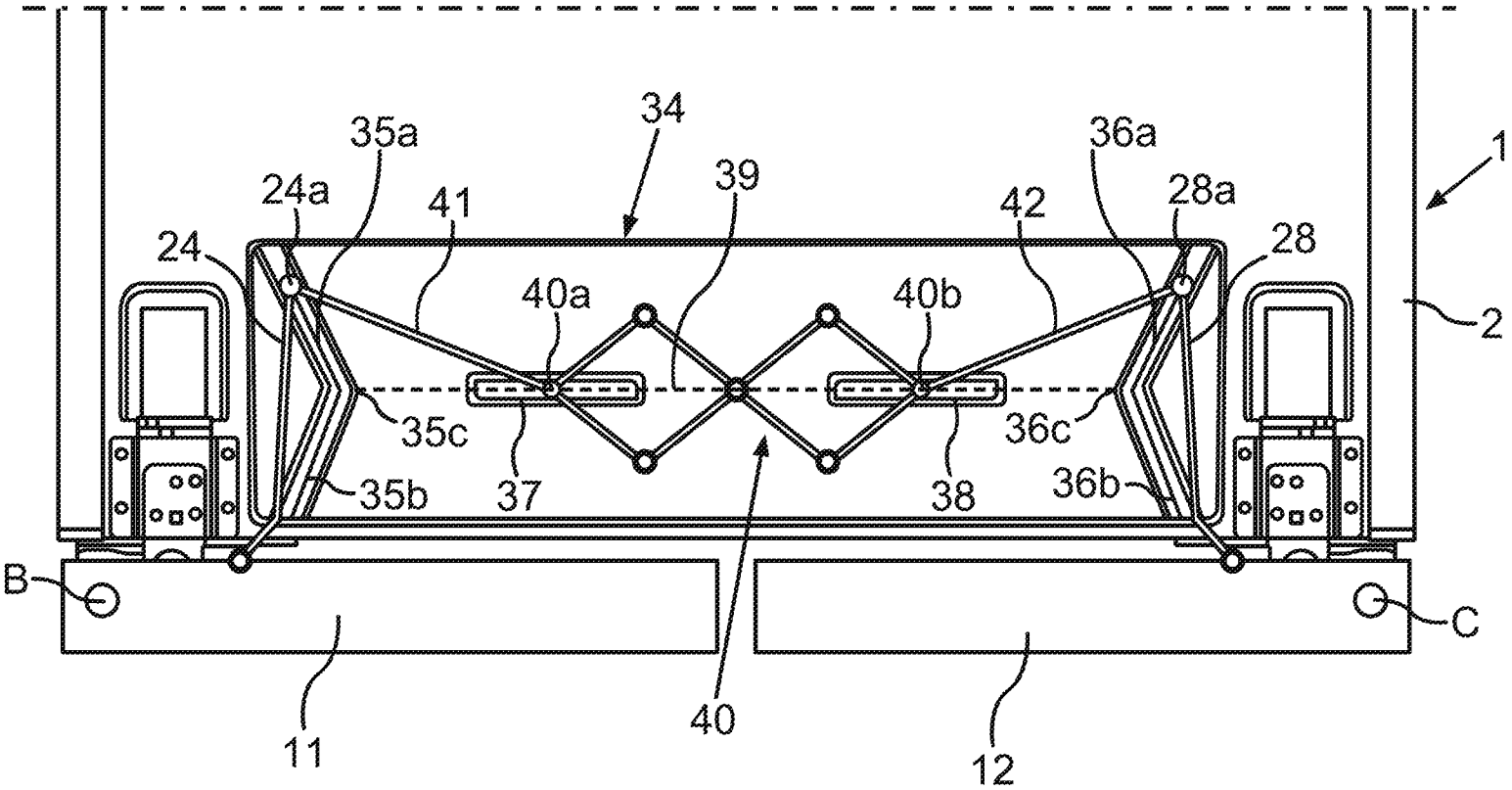
FIG. 7 a top view of the domestic cooling appliance with a moving device according to Fig., wherein the doors are closed.
Figure 8:
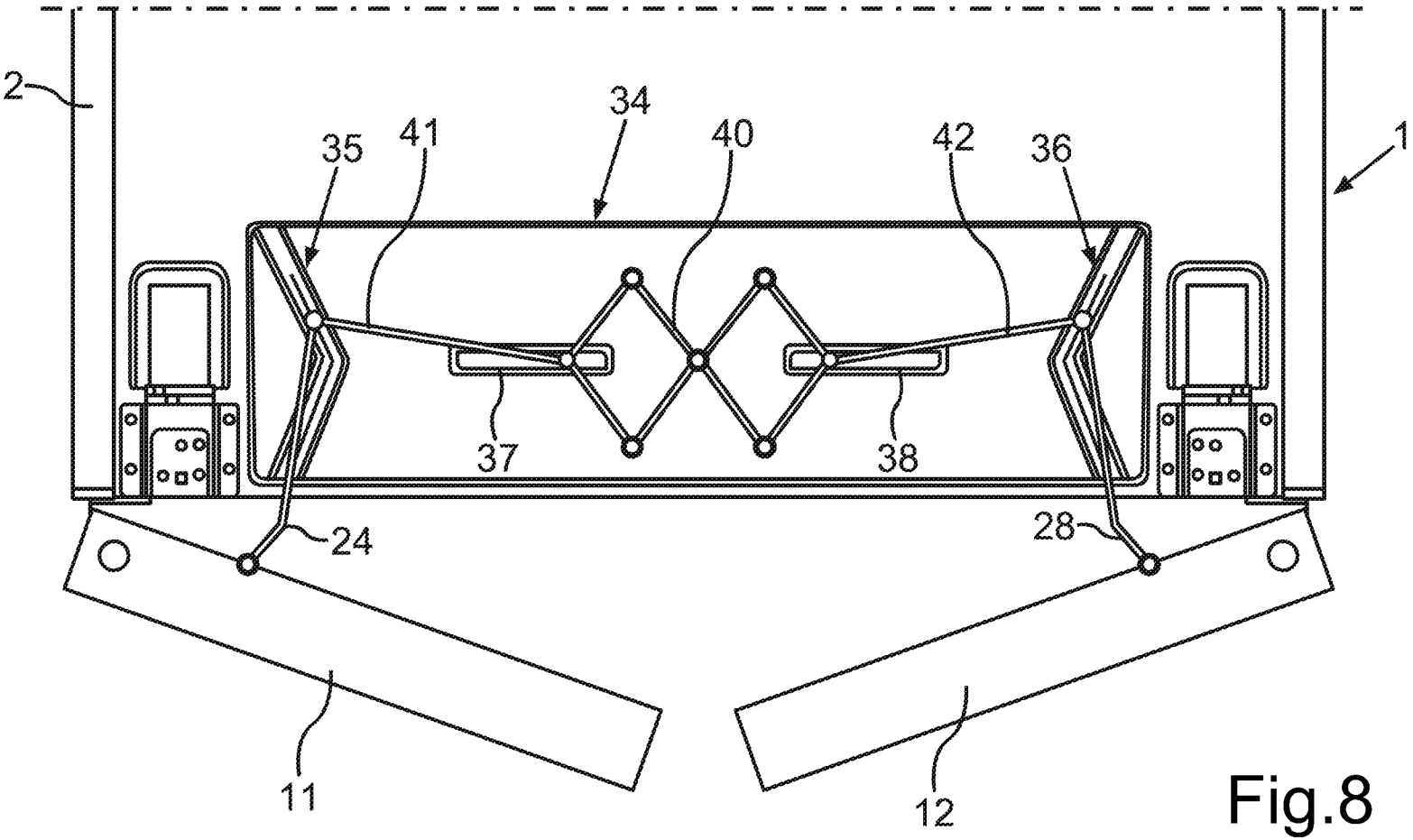
FIG. 8 a representation according to FIG. 7, wherein the doors are open in an intermediate position.

If, taking the illustration of FIG. 7 as a starting point, one of the two doors, for instance the first door 11, is opened, the coupling rod 24 is moved or guided from its end position according to FIG. 7 towards the tip 35*c*, as shown in an intermediate position according to FIG. 8. Resultant from this motion path, via coupling a compression of the scissor gear 40 occurs and in consequence thereof the connecting rod 42 is simultaneously pulled inwards, since the end 40*b* of the scissor gear 40 in the second linear guide rail 38 moves in the direction of the first linear guide rail 37. Thus, the coupling rod 28 with its end 28*a* is guided from its end position according to FIG. 7 towards the tip 36*c*.

FIG. 8 shows an intermediate position of the doors 11 and 12, in which the ends 24*a* and 28*a* have not yet reached the tips 35*c* and 36*c*. Nonetheless, FIG. 8 likewise illustrates the operating principle of coupling and concomitant motion such that automatically, consequent upon opening the first door 11, the movement of the second door 12 is effected via the moving device 20.

Consequent upon further opening the door 11, the end 24*a* is guided beyond the tip 35*c* and thus guided in the second guide rail section 35*b*. The same applies to the end 28*a*. In the context of the steadily increasing opening angle and the rigidity and longitudinal stability of the coupling rods 24 and 28, the orientation of the guide rails 35*b* and 36*b* diagonally outwards is advantageous, wherein this orientation is to be understood as an orientation extending from the tips 35*c* and 36*c* to the front ends of said guide rail sections 35*b* and 36, which face away from the first guide rail sections 35*a* and 36*a*, respectively.

Figure 9:
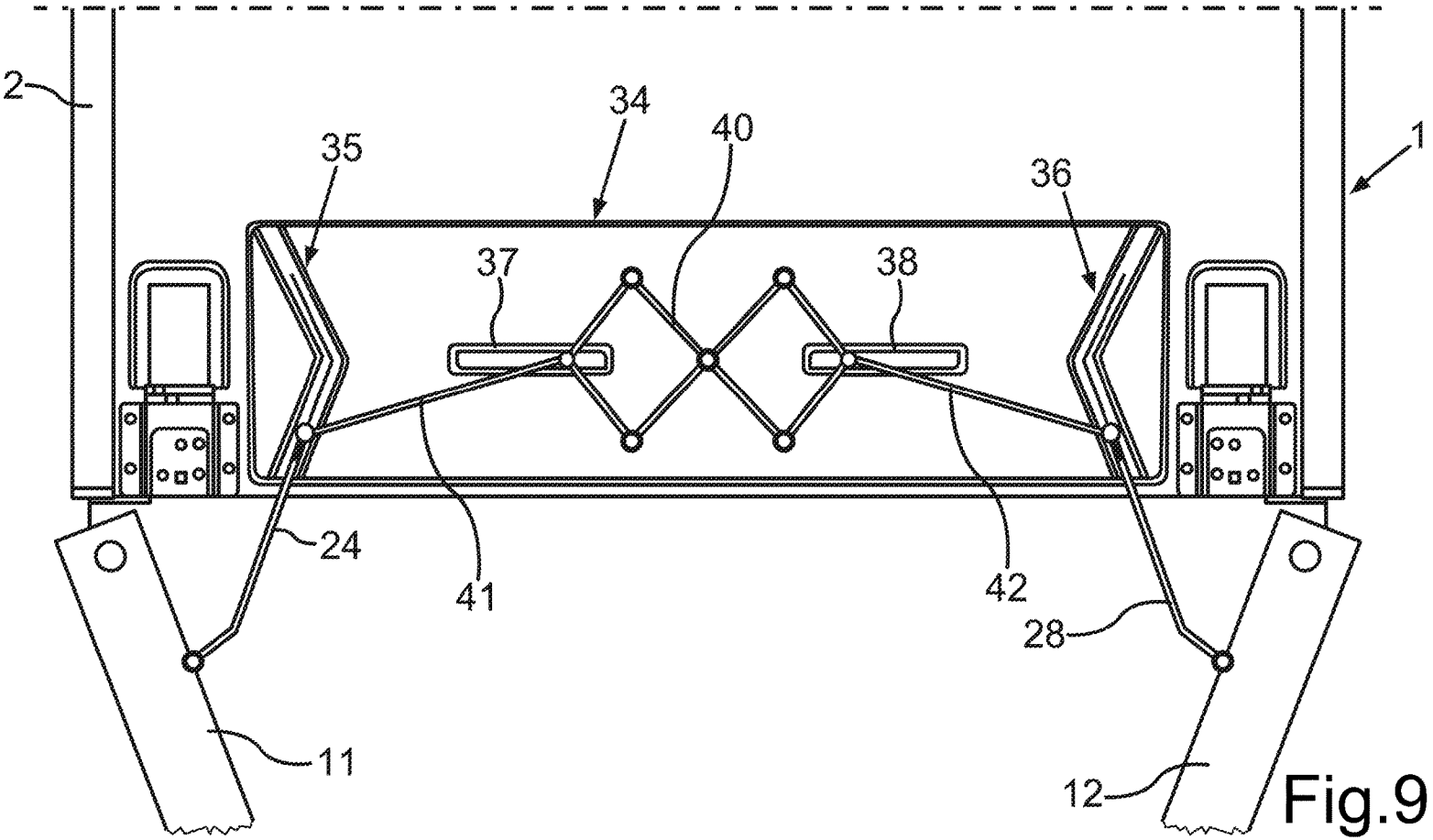
FIG. 9 the representation according to FIG. 7 and FIG. 8, with the doors in a still further opened intermediate position.

Finally, FIG. 9 shows a top view representation of a further open intermediate position of the doors 11 and 12, where the ends 24*a* and 28*a* are already guided in the second guide rails sections 35*b* and 36, but the completely open end position of the doors 11 and 12 has not yet been reached. In this embodiment, it is in particular provided that a maximum opening angle is larger than 95°, in particular 100°.

The following is a summary list of reference numerals and the corresponding structure used in the above description of the invention:

1 domestic cooling appliance
2 housing
3 receiving space
4 receiving opening
5 delimiting wall
6 delimiting wall
7 delimiting wall
8 delimiting wall
9 receiving space
10 door
11 door
11 a door end profile
12 door
12*a* door end profile
13 inside of the door
14 inside of the door
15 door rack
16 door pillar
17 guiding device
18 guiding device
19 inner container
20 moving device
21 operating unit
22 operating unit
23 belt
24 coupling rod
24*a* end
25 coupling wheel
26 positioning bracket
27 coupling area
28 coupling rod
28*a* end
29 coupling wheel
30 positioning bracket
31 receiving housing
32 inlet
33 outlet
34 guiding element
35 non-linear guide rail
35*a* first guide rail section
35*b* second guide rail section
35*c* tip
36 non-linear guide rail
36*a* guide rail section
36*b* guide rail section
36*c* tip
37 linear guide rail
38 linear guide rail
39 connecting line
40 scissor gear
40*a* end
40*b* end
41 connecting rod
42 connecting rod

The invention claimed is:

1. A domestic cooling appliance, comprising:

a housing;

at least one receiving space for receiving food formed in said housing;

two doors including a first door pivotally mounted at said housing and a second door pivotally mounted to said housing;

said two doors being arranged adjacent one another for closing said at least one receiving space at a front thereof;

a moving device, formed with a first operating unit at said first door, a second operating unit at said second door and a belt connecting said first operating unit to said second operating unit, coupling said two doors to one another so that, upon operation of one of said two doors, a concurrent movement of equal type is automatically effected of the other of said two doors by said belt being disposed to transfer a movement of one said operating unit, generated by a movement of a respective said door at which said operating unit is arranged, to the respectively other said operating unit; and said first operating unit including a coupling rod pivotally mounted to said first door.

2. The domestic cooling appliance according to claim 1, wherein said moving device is a purely mechanical device.

3. The domestic cooling appliance according to claim 1, wherein said belt is a rope or a chain.

4. The domestic cooling appliance according to claim 1, wherein said belt is arranged between said first and second operating units with a crossover crossing itself.

5. The domestic cooling appliance according to claim 1, wherein said coupling rod is a toothed rack.

6. The domestic cooling appliance according to claim 1, wherein said first operating unit includes a rotatable coupling wheel arranged at said housing externally to said first door and to which said belt is firmly coupled such that a rotation of said coupling wheel effects a movement of said belt.

7. The domestic cooling appliance according to claim 6, wherein said coupling wheel is a toothed wheel.

8. The domestic cooling appliance according to claim 6, wherein said coupling wheel is disposed in a receiving housing and said coupling rod enters said receiving housing via an inlet and exits said receiving housing via an outlet.

9. The domestic cooling appliance according to claim 6, wherein said first operating unit comprises a coupling rod pivotally mounted to said first door and directly coupled to said coupling wheel.

10. The domestic cooling appliance according to claim 9, which comprises a positioning bracket disposed in a coupling area between said coupling rod and said coupling wheel, said positioning bracket extending from said coupling wheel across said coupling rod and engages behind said coupling rod.

11. The domestic cooling appliance according to claim 1, wherein said second operating unit comprises a coupling rod pivotally arranged at said second door and said second operating unit comprises a rotatable coupling wheel arranged at said housing externally to said second door and having a belt firmly coupled such that a rotation of said coupling wheel effects a movement of said belt.

12. The domestic cooling appliance according to claim 11, wherein said coupling rod is a toothed rack and said coupling wheel is a toothed wheel.

13. The domestic cooling appliance according to claim 11, wherein said coupling wheel is disposed in a receiving housing and wherein one or both of the following is true:

said coupling rod enters said receiving housing via an inlet and exits said receiving housing via an outlet and said coupling rod is coupled directly to said coupling wheel.

14. The domestic cooling appliance according to claim 13, which comprises a positioning bracket is arranged in a coupling area between said coupling rod and said coupling wheel, said positioning bracket extending from said coupling wheel across said coupling rod and engaging behind said coupling rod.

* * * * *